US005738432A

United States Patent [19]

Okko et al.

[11] Patent Number: 5,738,432

[45] Date of Patent: Apr. 14, 1998

[54] ILLUMINATION DEVICE AND A METHOD

[76] Inventors: Koussay Okko; Maad Okko; Nagib Okko, all of 1124 E. Balboa Blvd., Newport Beach, Calif. 92661

[21] Appl. No.: 759,383

[22] Filed: Dec. 4, 1996

[51] Int. Cl.[6] ..... F21L 15/08; F21L 7/00

[52] U.S. Cl. ..... 362/103; 362/190; 362/191; 362/197; 362/269; 362/427

[58] Field of Search ..... 362/103, 190, 362/191, 197, 269, 396, 398, 427, 108; 36/137

[56] References Cited

U.S. PATENT DOCUMENTS

| | | | |
|---|---|---|---|
| 2,671,847 | 3/1954 | Lerch | 362/191 |
| 4,967,323 | 10/1990 | Johnson et al. | 362/103 |
| 5,440,465 | 8/1995 | Hasness | 362/398 |
| 5,456,197 | 10/1995 | Chien | 36/137 |
| 5,460,346 | 10/1995 | Hirsch | 362/190 |
| 5,508,899 | 4/1996 | McCormick | 36/137 |
| 5,516,149 | 5/1996 | Moore | 362/103 |
| 5,658,065 | 8/1997 | Jamieson | 362/191 |

FOREIGN PATENT DOCUMENTS

| | | | |
|---|---|---|---|
| 2045914 | 11/1980 | United Kingdom | 362/108 |

*Primary Examiner*—Stephen F. Husar
*Assistant Examiner*—Matthew Spark
*Attorney, Agent, or Firm*—Law Offices of Sandra M. Parker

[57] ABSTRACT

A method and an adjustable portable illumination device, removably attachable to a user's shoe or garment, enabling hands-free operation, and allowing the user to see and be seen. The device has a light housing, a light assembly having an illumination member encapsulated in the light housing, a power source for providing power to the illumination member, a movable plate, attached to the light housing and a light housing attaching member for removably attaching the light housing to the top frontal area of a user's shoe, or on an other article of clothing. The movable plate has a swivel member attached to the movable plate, for vertical positioning of the light housing at an adjustable angle between 20 and 70 degrees relative to the ground. The leg is adjustably and fixedly attached to the top of the movable plate with a rotatable mechanical member and a frictional member, whereby allowing a three-hundred sixty degree rotation of the light housing for horizontal repositioning thereof and for orienting it to a selectively chosen fixed angular position, maintained by the frictional member.

20 Claims, 2 Drawing Sheets

ILLUMINATION DEVICE AND A METHOD

BACKGROUND OF THE INVENTION

1. Field of the Invention

This invention generally relates to the field of lighting assemblies useful to illuminate the path of travel and to increase wearer's visibility. The present invention is particularly directed towards a method and an adjustable portable illumination device, removably attachable to a user's shoe or garment, enabling hands-free operation, and allowing the user to see and be seen, worn by joggers, cyclists, workers and the like.

2. Brief Description of the Prior Art

Poor visibility is a serious problem at night for pedestrians, outdoor walkers and exercisers, sportsmen, police officers, firefighters, construction workers, railroad workers, maintenance workers and the like. They need portable illumination devices with light beams directed forwardly to illuminate the path being taken by the wearer or the object being pointed at.

Conventional illumination devices mounted on shoes or other articles of clothing, known in prior art, mostly deal with illumination devices intended for aesthetic reasons, at the dance floor and the like, and can not adequately illuminate the directionally forward pathway taken by night-time walkers, joggers and other sportsmen. In addition, in some devices the light is cumbersomely located and difficult to repair or replace, if misfunctions or wears out.

Although somewhat helpful, these devices are inflexible and unable to cover users' needs. For example, U.S. Pat. No. 5,329,432 issued in 1994 to Bland for Luminaire-Provided Footware, has an incandescent lamp placed in a tongue forward-fold and a battery placed behind the tongue forward-fold. The device cannot be used anywhere else and each pair of shoes to have this type of lamp would have to be custom made and is only useful for this purpose.

Regular flashlights are more convenient, but have a disadvantage that the user must hold the light in his or her hand, or find other suitable support for the flashlight, so that the light will correctly illuminate the work or pathway area. Some flashlights are attachable to the clothing by clips, strings or the like. For example, U.S. Pat. No. 5,412,896 issued in 1995 to Morgan describes a utility device for a fisherman and other outdoor sportsmen, including a flashlight, worn around the neck.

There is a need for a device that would adequately illuminate the directionally forward pathway being taken by night, so as to alert the person of perils that might exist along the intended pathway. There is also a need for a simple, portable illumination device enabling users to see and be seen, and capable to ensure consistency of light direction when placed on shoes or other articles of clothing.

SUMMARY OF THE INVENTION

Accordingly, the present invention satisfies the need for an illumination device which can be used for safety purposes to see and to be seen, having a forwardly shining light to reveal hazards along the user's path and to forewarn the wearer of dangerous obstructions such as curbs, pot holes, stones along the path of travel and the like.

It is an object of the present invention to provide a portable, lightweight, compact, flexible and convenient illumination device, which can adequately illuminate the directionally forward pathway being taken by nocturnally walking, running, rollerblading, biking or skiing persons, so as to alert them of perils that might exist along their intended pathways and to make them visible to the others.

Another object of the present invention is an illumination device capable of illuminating an area from one to six feet in front of the light wearer, that will warn its user to avoid dangers along his own path, and to enhance person's visibility to the motorists.

Still another object of the present invention is an illumination device that, when in use, allows hands-free mobility, for night skiers and other sportsmen, for making emergency roadside repairs, for fisherman during night fishing or for other people who work at night.

Yet another object of the present invention is an illumination device to be securely and replaceably positioned on the top of regular athletic shoes or other selectable footware, with soft or with hard shell, with or without shoe laces and/or straps, that can be centered on top of regular shoes, rollerblading shoes, skateboarding shoes, running shoes, tennis shoes, mountain hiking boots, skiing and snowboarding boots, and be usable without requiring any modification of the shoes.

Still another object of the present invention is an illumination device removably attachable and incorporated into articles of clothing, such as belts, hats, headbands, hang around the neck on a neck strap or the like.

Another object of the present invention is an illumination device which can be used on different shoes without any adjustment, or a device that can be made with slightly different attachment features for accommodation of different lacing patterns.

Yet another object of the present invention is an illumination device that can be easily affixed and removed by any attachment means, including slidable removable plates, clips, strings, straps, hook-and-eyes material, mechanical fasteners and the like.

Still another object of the present invention is an illumination device with a wide range of positioning adjustability, to enable the wearer to direct the light at a desired point.

Yet another object of the present invention is an illumination device that has aesthetically pleasing features, not envisioned previously on articles of clothing and on footware.

The present invention encompasses an adjustable portable illumination device, removably attachable to a user's shoe or garment, enabling hands-free operation, and allowing the user to see and be seen. The device has a light housing, a light assembly having an illumination member encapsulated in the light housing, a power source for providing power to the illumination member, a movable plate, attached to the light housing, and a light housing attaching member for removably attaching the light housing to a top frontal area of a user's shoe, or on an other article of clothing, wherein the device is sized for use with shoes, boots and articles of clothing, such as belts, hats, headbands, wastebands and necklaces.

The movable plate has a swivel member attached to the movable plate, wherein the swivel member comprises a leg with a tilt knee, a tilt knee switch, a top section, and a bottom section. The top section and the bottom section are pivotally connected with the tilt knee and fastened with the tilt knee switch, for vertical positioning of the light housing at an adjustable angle between 20 and 70 degrees relative to the ground.

The leg is adjustably and fixedly attached to the top of the movable plate with a rotatable mechanical member and a frictional member, whereby allowing a three-hundred sixty degree rotation of the light housing for horizontal repositioning thereof, and for orienting it to a selectively chosen fixed angular position, maintained by the frictional member. The light housing attaching member has a base plate having on its sides a plurality of openings for shoe laces, straps, belts, bands or other parts of shoes or garments. The base plate has a top member made of a rigid and resilient material, and a bottom member made of a relatively thin, flexible and bendable material, to substantially conform in shape with the top of a user's shoe, piece of clothing, or a body part.

Another embodiment of the invention is a method of illuminating person's path or object with an illumination device removably attachable to shoes, boots or articles of clothing, such as belts, hats, headbands, wastebands or necklaces for hands-free operation. The method has the following steps: attaching a light housing on a light housing positioning member, removably attaching the light housing to the top frontal area of a user's shoe or on other article of clothing, and using the light housing positioning member for selectively positioning the light housing for directing a beam of light forwardly of and downwardly from the light housing.

The step of removably attaching the light housing to the top frontal area of a user's shoe or on other article of clothing has a step of releasably affixing a movable plate to a base plate with a slidable motion, wherein the movable plate is attached to the light housing and having a latch and a movable plate recess, and the base plate is attached to the user's shoe or garment and having on its sides a plurality of openings for shoe laces, straps, belts, bands or other parts of shoes or garments, and the base plate has a plate latch opening for securely latching the moving plate and the base plate in a plug-in connection.

DESCRIPTION OF THE DRAWINGS

The features of the present invention can be best understood together with further objectives and advantages by reference to the following description, taken in connection with the accompanying drawings, wherein like numerals indicate like parts.

DESCRIPTION OF THE INVENTION

Figure 1:
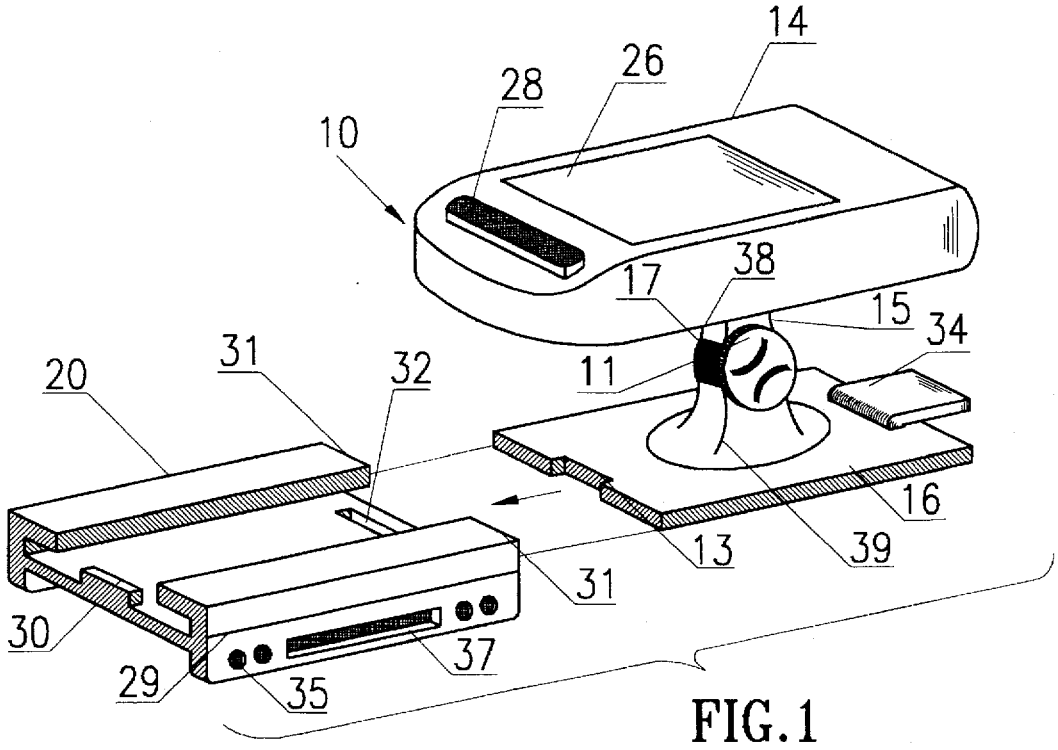
FIG. 1 is a back perspective view of an illumination device, in accordance with the preferred embodiment of the present invention.

In the following description, numerous specific details are set forth in order to provide a more thorough description of the invention. It will be apparent, however, that the present invention may be practiced without these specific details. In other instances, well known features have not been described in detail so as not to unnecessarily obscure the present invention.

The present invention is a light assembly used for safety purposes and capable of illuminating an area from one to six feet in front of the light wearer. It has a forwardly beaming light to aid user at night, to reveal hazards along the user's path and to forewarn the wearer of dangerous obstructions such as curbs, pot holes, stones and the like, As presented in FIG. 1, this invention is a small light assembly 10, having a miniature battery-powered flashlight 12, shown in detail in FIG. 4, encapsulated in a light housing 14, at the frontal end of the light assembly 10. The light housing 14 is preferably aerodynamic in shape, but can have rectangular, round, or any other suitable shape. Light housing 14 has to be selectively positionable and have a wide range of positioning adjustability, to enable the wearer to direct the light at a desired point and to allow forward and downward viewing of the area being lighted.

Therefore, the light housing 14 is fixedly attached to a movable plate 16 with in a swivel arrangement like a leg 15. The leg 15 has a top 38 and a bottom section 39, pivotally connected with a tilt knee 17, adjustable with a tilt knee switch 11, shaped as a screw or as a knob for two fingers. The tilt knee 17 allows vertical positioning of the light housing 14 at an adjustable angle between generally 20 and 70 degrees relative to the ground.

The leg 15 is adjustably and fixedly attached to the top of the movable plate 16 of the light assembly 10 with a rotation assembly 18, allowing a three-hundred sixty degree rotation of the light housing 14 for horizontal repositioning. The rotation assembly 18 allows rotation of the leg 15 and the light housing 14, while the light assembly 10 is attached to an article. The light housing 14 is rotatable about an axis, for orienting it to a selectively chosen fixed angular position and direction, maintained by a friction member 33, thereby causing light rays emanating from the light projecting flashlight 12 to illuminate in the desired direction.

Figure 2:
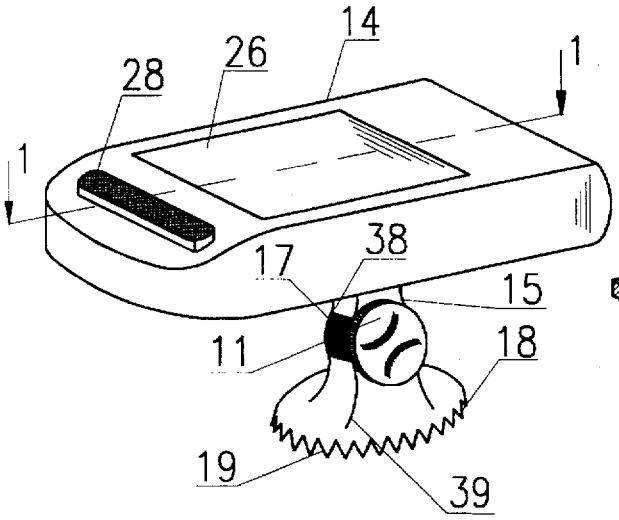
FIG. 2 is a back perspective view of the top part of the illumination device presented in FIG. 1, in accordance with the preferred embodiment of the present invention.

As shown in FIG. 1, one embodiment of the present invention can have the rotation assembly 18 to be made like a screw, not visible, placed through the movable plate 16 and the leg 15. FIG. 2 illustrates a more complex mechanism for the rotation assembly 18, including a ratchet wheel with a notched, tapering teeth set 18 with the friction member, represented in this embodiment of the present invention with a pawl 33, to frictionally engage and hold the light housing 14 in position or to disengage the teeth and to rotate the light housing 14 to the desired position.

The ratchet wheel 18, like the one used in the present invention, is a conventional part known in the art, used for mounting antennas on boats and the like, and therefore is not shown in the FIGS. 1–5 in great detail. The ratchet wheel 18 has a top teeth section 19 on the bottom section 39 of the leg 15, and a bottom teeth section 21 on the top of a third section 23, placed on the top of the movable plate 16. The pawl 33 is placed on a side of the third section 23 of the ratchet wheel 18. The bottom side of the bottom teeth section 21 is not visible and has two protruding semicircles with an inclining surface on each.

The top of the third section 23 is not visible, and has two hollow semicircles with two small notches, adapted to engage with the protruding semicircles, when the light housing 14 is in a right position and is locked at an angle to illuminate in the required direction with the turning of the pawl 33. When the pawl 33 is turned in the other direction, the teeth sections 19 and 21 disengage to allow turning of the light housing 14, but are still held together with a nut 49. The nut 49 is placed through an opening made in the third section 23 and the teeth sections 21 and 19.

In the preferred embodiment of the present invention, the movable plate 16 is adapted to be slidably attached to a base plate 20. The base plate 20 is attachable to the regular shoe or boot and therefore has on its sides several matching openings, some smaller round or oval shaped openings 35 for shoe laces or belt straps, and a longer rectangular opening 37 for the models with a shoe or boot strap. The movable plate 16 with the light housing 14 can be carried around and placed on a shoe or boot when needed.

In the preferred embodiment of the present invention, the movable plate 16 is releasably affixed to the base plate 20 with a slidable motion, although some other methods of attachment to the shoes or garments are also possible, like clips, strings, straps, hook-and-eyes material, mechanical fasteners and the like, with or without the base plate 20. The advantage of the illumination device of the present invention is that it can be used on different shoes, boots, belts, etc., without any adjustment, or can be made with slightly different attachment features for accommodation of different lacing patterns or the like.

Figure 4:
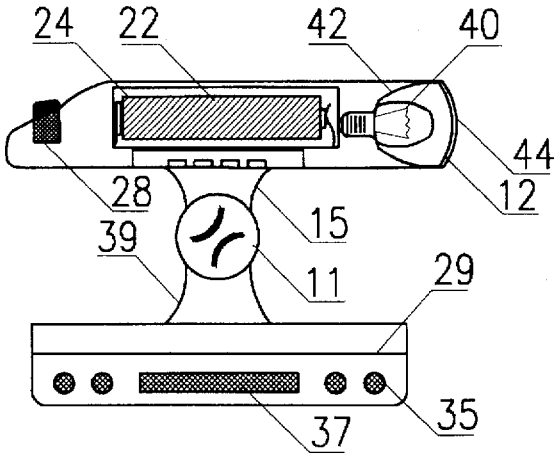
FIG. 4 is a cross-sectional elevational view of the top part of the illumination device, taken along line 1—1 of FIG. 2, in accordance with the preferred embodiment of the present invention.
Figure 5:
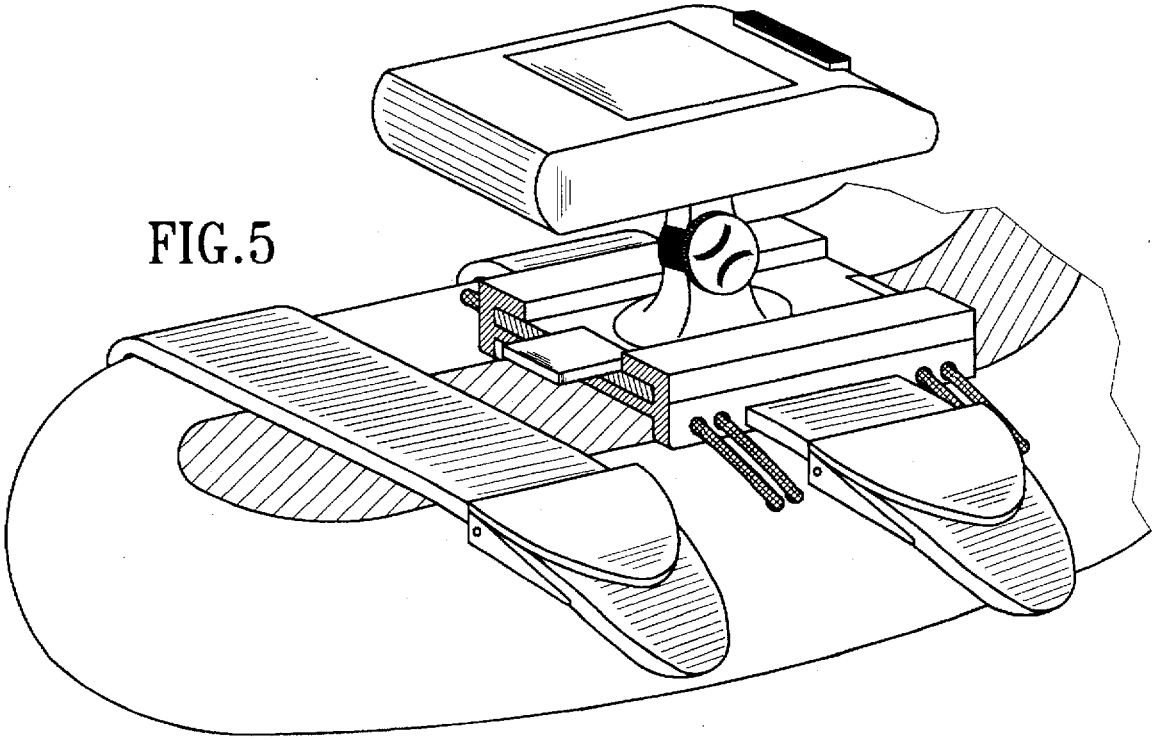
FIG. 5 is a front perspective view of the illumination device of FIG. 1, presented as mounted on a rollerblade shoe, in accordance with the preferred embodiment of the present invention.

A DC power source for the light assembly 10 is a conventional battery 22, shown in FIG. 4 as placed within a battery housing 24 through an access cover 26. The access cover 26 is shown in FIGS. 1 and 2, and in the preferred embodiment of the present invention it is placed on the top of the light assembly 10. An ON/OFF manual switch 28 is also placed on the top of the light assembly 10. The battery 22 could be a conventional carbon-zinc or equivalent battery type power source unit, and several battery elements can be stored in the battery housing 24, producing electricity to light up the flashlight 12 when the ON/OFF 28 switch is on. The ON/OFF 28 switch is a spring-loaded pressure switch, electrically connected with the battery 22, for enabling an energizing circuit for the flashlight 12. The ON/OFF switch 28 could also be a compression spring-loaded switch with a lever, not shown, which can rotate to the position for closing the ON/OFF switch 28, or any other type of a switch.

As presented in FIG. 4, the flashlight 12 of the light assembly 10, encapsulated in the light housing 14, contains a lamp 40, a reflector 42 and a lamp cover 44. Preferably, the flashlight 12 has an elongated light emitting face, but can have any other suitable shape. The flashlight 12 is connected to the battery housing 24 with conventional electrical conductors, not shown. The lamp 40 can be a conventional Tungsten-filamentary or halogen incandescent bulb or any other conventional light source. Light from the lamp 40 is directed through the lamp cover 44. Reflector 24 is an elongated or cone shaped directional reflector, made of metal or plastic with metallic finish, and designed for forwardly directing the light of the lamp 40, due to its shape and the shiny metallic finish.

As mentioned previously and shown in FIGS. 1–3, when in use, two elongated plates, the base plate 20 and the movable plate 16, are removably attached to each other to form an integral piece. The movable plate 16 is releasably affixed to the base plate 20 with a sliding motion, although some other method of attachment is also possible. When the light is needed, the movable plate 16 is inserted at the frontal end of the base plate 20 between two side ridges 31, one on each side of the base plate 20, and slid all the way until a movable plate recess 13 is latched to the back wall protrusion 30 at the base plate 20.

The movable plate 16 is affixed to a base plate opening 32 at the frontal end of the base plate 20 by a plug-in connection 34, placed on the movable plate 16. Instead of the plug-in connection 34, which is slidably received inside the base plate opening 32 and engages and releases the connection with the base plate opening 32 when pressed down, some other securing device with resilient closing means, with pressure and/or friction fitting, can also be used.

The light assembly 10 of the present invention has to be compact and lightweight, and may be formed of a light, rigid and resilient material like metal, plastic like ABS plastic, nylon, or other appropriate material. For models intended to be used with skiing, hiking and snowboarding boots, the light assembly must be made to be waterproof. The base plate 20 of the present invention is made in two parts, joined at a junction 29, shown in FIGS. 1, 4 and 5. Its top member is made of a rigid and resilient material and its bottom member is made of a relatively thin, flexible and bendable material, to substantially conform in shape with the top of a user's shoe, piece of clothing, or a body part.

Figure 3:
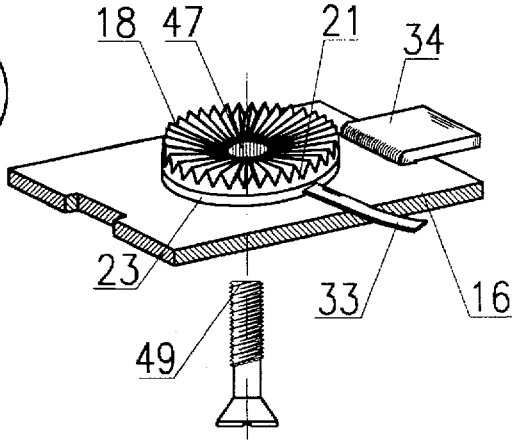
FIG. 3 is a perspective view of the bottom part of the illumination device presented in FIG. 1, in accordance with the preferred embodiment of the present invention.

In an alternative embodiment, instead of using the base plate 20, a securement clip, not visible, can be attached to the bottom of the moving plate 16, like the one shown in FIG. 3. The movable plate 16 might have to be slightly modified for this embodiment of the present invention, to accommodate the securement clip. The securement clip can be used to attach the light assembly 10 to an object, which could be, but does not have to be, a piece of clothing, like a belt, a headband, a shoe lace or strap, a dog collar, etc.

In some other embodiments, a permanent magnet assembly or a hook and loop connection can be used instead of the base plate 20, and it might be placed under the shoe laces, tied around a shoe with a strap or the like. Accordingly, the light assembly of the present invention can be made relatively small, portable, inexpensive, compact, light in weight, durable and efficient for its intended use.

While the proffered embodiments have been described and illustrated, various modifications and substitutions may be made thereto without departing from the scope of the invention. Accordingly, it should be understood that the present invention has been described by way of illustration and not limitation.

For example, an electric generator can be provided inside a watertight compartment adjacent to a heel portion of the shoe sole, to produce voltage when pressure is applied on the shoe sole during use. A rechargeable battery can be charged by the voltage from this electric generator. The light assembly 10 can also be made of reflective material and it could use a light emitting device and/or solar cells.

In addition, an attachable colored lens can be added to alter the color of the light emitted from the light assembly 10, useful for people suffering from certain types of color vision deficiencies, to help wearer see certain colors which would otherwise appear similar to others. A red filter lens can be used to repel bugs.

We claim:

1. An adjustable portable illumination device, removably attachable to a user's shoe or garment, enabling hands-free operation, and allowing the user to see and be seen, comprising:

a light housing;

a light assembly having an illumination means, encapsulated in the light housing;

a power source for providing power to the illumination means;

a movable plate, attached to the light housing, having a plate latch means and a swivel means attached to the movable date for selectively positioning the illumination means in order to direct a beam of light from the illumination means forwardly of and downwardly from said light housing, wherein the swivel means comprises a leg having a tilt knee, a tilt knee knob, a top section, and a bottom section, and wherein said top section and said bottom section are pivotally connected with the tilt knee and fastened with the tilt knee knob, for vertical positioning of the light housing at an adjustable angle relative to ground;

a light housing attaching means for removably attaching the light housing to a top frontal area of the user's shoe, or on an other article of clothing; and wherein the device is sized for use with shoes, boots and articles of clothing.

2. The device as claimed in claim 1, wherein the light housing attaching means comprises a base plate, wherein the base plate has sides and on the sides a plurality of openings for attachment means selected from the group consisting of shoe laces, straps, belts, and bands, and the base plate has a plate latch opening for securely latching the plate latch means of the moving plate and the base plate in a plug-in connection.

3. The device as claimed in claim 2, wherein the base plate comprises a top member made of a rigid and resilient material, and a bottom member made of a relatively thin, flexible and bendable material, to substantially conform in shape with a top of the user's shoe, piece of clothing, or a body part.

4. The device as claimed in claim 1, wherein the adjustable angle is between 20 and 70 degrees relative to ground.

5. The device as claimed in claim 1, wherein the leg is adjustably and fixedly attached to the top of the movable plate with a rotatable mechanical means and a frictional means, whereby allowing a three-hundred sixty degree rotation of the light housing for horizontal repositioning thereof in a horizontal plane parallel to ground and for orienting the light housing to a selectively chosen fixed angular position, maintained by the frictional means.

6. The device as claimed in claim 5, wherein the rotatable mechanical means comprises a screw means.

7. The device as claimed in claim 5, wherein the rotatable mechanical means comprises a rotatable connection means, wherein the rotatable connection means allows a three-hundred sixty degree rotation of the light housing for horizontal repositioning thereof in a horizontal plane parallel to ground, and wherein the frictional means comprises a rotation prevention means for locking the light housing at an appropriate angle to illuminate in a predetermined direction.

8. The device as claimed in claim 5, wherein the rotatable mechanical means comprises a ratchet wheel means having a first teeth member and a second teeth member, wherein the first teeth member is attached to the leg and the second teeth member is attached at the movable plate, and wherein the frictional means comprises a pawl for engaging and disengaging said first teeth member and said second teeth member for locking the light housing at an appropriate angle to illuminate in a predetermined direction.

9. The device as claimed in claim 1, wherein the movable plate comprises a hook fastener and the user's shoe or garment having a loop fastener, said hook fastener and said loop fastener being able to be releasably connected together in an overlapping arrangement.

10. The device as claimed in claim 1, wherein the movable plate has a permanent magnet means for attaching the light housing to a user's shoe or garment, or to another magnetic object.

11. The device as claimed in claim 1, wherein the movable plate has a securement clip adaptable for attaching the light housing to the user's shoe or garment.

12. The device as claimed in claim 1, wherein said illumination means comprises a lamp, a reflector, and a lamp cover, and wherein said power means is at least one DC battery.

13. The device as claimed in claim 1, wherein material selected for the device is rigid and resilient and selected from a group consisting of metal and plastic.

14. The device as claimed in claim 1, wherein the device is made to be waterproof, when intended for use with a skiing, hiking and snowboarding boot.

15. An adjustable portable illumination device, removably attachable to a user's shoe or garment, enabling hands-free operation, and allowing the user to see and be seen, comprising:

a light housing;

a light assembly having an illumination means, encapsulated in the light housing;

a power source for providing power to the illumination means;

a movable plate, attached to the light housing, having a swivel means attached to the movable plate, wherein the swivel means comprises a leg having a tilt knee, a tilt knee knob, a top section, and a bottom section, and wherein said top section and said bottom section are pivotally connected with the tilt knee and fastened with the tilt knee knob, for vertical positioning of the light housing at an adjustable angle between 20 and 70 degrees relative to ground;

wherein the leg is adjustably and fixedly attached to the top of the movable plate with a rotatable mechanical means and a frictional means, whereby allowing a three-hundred sixty degree rotation of the light housing for horizontal repositioning thereof in a horizontal plane parallel to ground and for orienting the light housing to a selectively chosen fixed angular position, maintained by the frictional means;

a light housing attaching means for removably attaching the light housing to a top frontal area of user's shoe, or garment; and wherein the device is sized for use with shoes, boots and articles of clothing.

16. The device as claimed in claim 15, wherein the light housing attaching means comprises a base plate, wherein the base plate has sides and on the sides a plurality of openings for attachment means selected from the group consisting of shoe laces, straps, belts, and bands.

17. The device as claimed in claim 16, wherein the base plate comprises a top member made of a rigid and resilient material, and a bottom member made of a relatively thin, flexible and bendable material, to substantially conform in shape with the top of a user's shoe, piece of clothing, or a body part.

18. The device as claimed in claim 15, wherein the rotatable mechanical means comprises a ratchet wheel means having a first teeth member and a second teeth member, wherein the first teeth member is attached to the leg and the second teeth member is attached at the movable plate, and wherein the frictional means comprises a pawl for engaging and disengaging said first teeth member and said second teeth member for locking the light housing at an appropriate angle to illuminate in a predetermined direction.

19. A method of illuminating person's path or object with an illumination device removably attachable to shoes, boots or articles of clothing for hands-free operation, comprising the steps of:

attaching a light housing having illumination means on a light housing positioning means;

removably attaching the light housing to the top frontal area of a user's shoe or on other article of clothing; and using the light housing positioning means for selectively positioning the light housing for directing a beam of light forwardly of and downwardly from said light housing, wherein the step of removably attaching the light housing to the top frontal area of a user's shoe or on other article of clothing comprises releasably affixing a movable plate which has a swivel means to a base plate with a slidable motion, wherein the movable plate is attached to the light housing and having a latch and a movable plate recess, and the base plate is attached to the user's shoe or garment and wherein the base plate has sides and on the sides a plurality of openings for shoe laces, straps, belts, bands, and the base plate having a plate latch opening for securely latching the moving plate and the base plate in a plug-in connection.

20. The device as claimed in claim 19, wherein the swivel means comprises a leg having a tilt knee, a tilt knee knob, a top section, and a bottom section, and wherein said top section and said bottom section are pivotally connected with the tilt knee and fastened with the tilt knee knob, for vertical positioning of the light housing at an adjustable angle between 20 and 70 degrees relative to ground, while attached to the user' shoe or garment, wherein the leg is adjustably and fixedly attached to the top of the movable plate with a rotatable mechanical means and a frictional means, whereby allowing a three-hundred sixty degree rotation of the light housing for horizontal repositioning thereof in a horizontal plane parallel to ground and for orienting the light housing to a selectively chosen fixed angular position, maintained by the frictional means, and wherein the rotatable mechanical means comprises a ratchet wheel means having a first teeth member and a second teeth member, wherein the first teeth member is attached to the leg and the second teeth member is attached at the movable plate, and wherein the frictional means comprises a pawl for engaging and disengaging said first teeth member and said second teeth member for locking the light housing at an appropriate angle to illuminate in a predetermined direction.

* * * * *